US009024987B2

(12) United States Patent
Takahashi

(10) Patent No.: US 9,024,987 B2
(45) Date of Patent: May 5, 2015

(54) RECEIPT ISSUING APPARATUS AND CONTROL METHOD THEREOF

(71) Applicant: Toshiba Tec Kabushiki Kaisha, Shinagawa-ku, Tokyo (JP)

(72) Inventor: Shuji Takahashi, Shizuoka-ken (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 14 days.

(21) Appl. No.: 13/928,911

(22) Filed: Jun. 27, 2013

(65) Prior Publication Data

US 2014/0002566 A1 Jan. 2, 2014

(30) Foreign Application Priority Data

Jul. 2, 2012 (JP) ..... 2012-148354

(51) Int. Cl.
*B41J 2/32* (2006.01)

(52) U.S. Cl.
CPC ..... *B41J 2/32* (2013.01)

(58) Field of Classification Search
USPC ..... 347/171
See application file for complete search history.

(56) References Cited

U.S. PATENT DOCUMENTS 7,710,442 B2 * 5/2010 Lyons et al. ..... 347/171
7,839,425 B2 * 11/2010 Morrison ..... 347/171
8,823,756 B2 * 9/2014 Kobayashi ..... 347/171

FOREIGN PATENT DOCUMENTS

JP 2001-018562 1/2001

* cited by examiner

*Primary Examiner* — Huan Tran
(74) *Attorney, Agent, or Firm* — Amin, Turocy & Watson, LLP

(57) ABSTRACT

A receipt issuing apparatus includes a conveying unit conveys a receipt paper which consists of a strip-shaped thermal recording paper and on which pieces of promotion-related information are pre-printed at predetermined positions which are arranged at regular intervals in the longitudinal direction of the receipt paper, a thermal printing unit prints the detail data of a commodity transaction on the receipt paper conveyed by the conveying unit by thermal printing, a mask printing control unit overprints a mask data for hiding the information over the information printed on the receipt paper by the thermal printing unit and an issuing control unit issues a receipt by cutting off the receipt paper on which mask data is printed by the mask printing control unit at a position more upstream than the printing position of the mask data in the conveying direction of the conveying unit.

6 Claims, 8 Drawing Sheets

RECEIPT ISSUING APPARATUS AND CONTROL METHOD THEREOF

CROSS-REFERENCE TO RELATED APPLICATION

This application is based upon and claims the benefit of priority from Japanese Patent Application No. 2012-148354, filed Jul. 2, 2012, the entire contents of which are incorporated herein by reference.

FIELD

Embodiments described herein relate to a receipt issuing apparatus helpful in the promotion of a retail shop and a control method thereof.

BACKGROUND

A method which a receipt being printed with promotion information such as coupon information or discount information and be offered to a customer as a propaganda medium for promotion in a retail shop is utilized is widely used. For the sake of miniaturization and low-cost, a thermal printer is used as an issuing apparatus for issuing such a receipt, and a thermal recording paper is used on a receipt paper.

However, in the case which a thermal printer prints on a thermal recording paper in a thermal type, printing density becomes lower and lower as time elapses. Therefore, there exists a problem that the promotion effect is poor for the promotion information printed on a receipt becoming illegible after a period of time.

DETAILED DESCRIPTION

In accordance with one embodiment, a receipt issuing apparatus includes a conveying unit, a thermal printing unit, a mask printing control unit and an issuing control unit. The conveying unit configured to convey a receipt paper which consists of a strip-shaped thermal recording paper and on which pieces of promotion-related information are preprinted at predetermined positions which are arranged at regular intervals in the longitudinal direction of the receipt paper. The thermal printing unit configured to print the detail data of a commodity transaction on the receipt paper conveyed by the conveying unit by thermal printing. The mask printing control unit configured to overprint a mask data for hiding the information over the information printed on the receipt paper by the thermal printing unit. The issuing control unit configured to issue a receipt by cutting off the receipt paper on which mask data is printed by the mask printing control unit at a position more upstream than the printing position of the mask data in the conveying direction of the conveying unit.

Embodiments of the receipt issuing apparatus are described below with reference to accompanying drawings. Further, a thermal receipt printer 1 arranged in the internal of a POS terminal is used as a receipt issuing apparatus in embodiments described herein.

Figure 1:
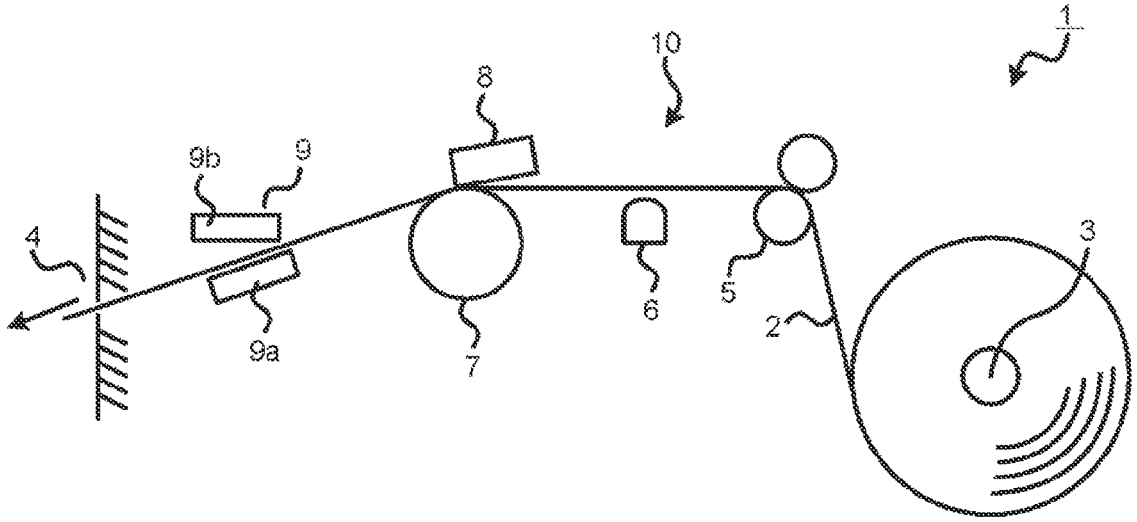
FIG. 1 is a schematic diagram illustrating the printing mechanism of a receipt printer according to one embodiment.
Figure 2:
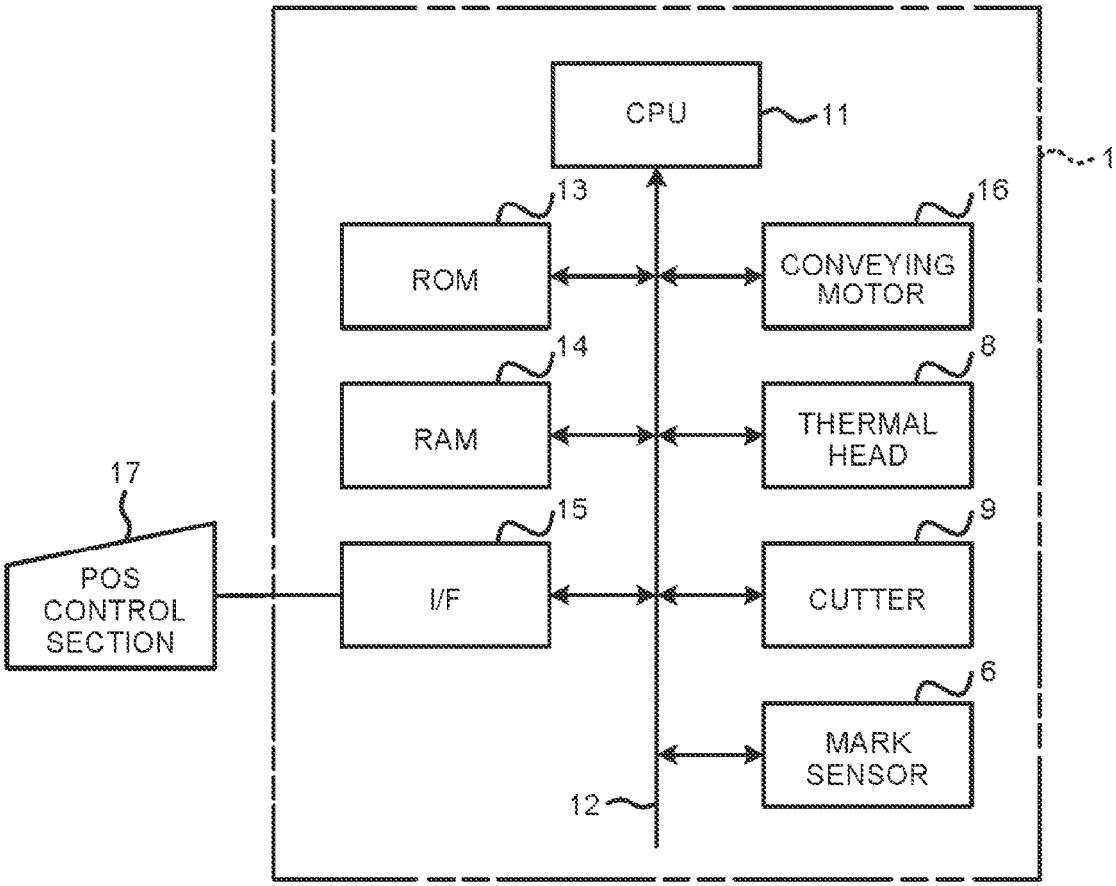
FIG. 2 is a block diagram illustrating hardware configurations of the receipt printer.

FIG. 1 is a schematic diagram illustrating the printing mechanism of the receipt printer 1, and FIG. 2 is a block diagram illustrating hardware configurations of the receipt printer 1. As shown in FIG. 1, in the receipt printer 1, a paper conveyance path 10 for conveying a receipt paper 2 serving as a printing medium is formed from a roll paper holding portion 3 to a receipt issuing port 4. Moreover, a guide roller 5, a mark sensor 6, a platen roller 7, a thermal head 8 and a cutter mechanism 9 are sequentially arranged from the roll paper holding portion 3 along the paper conveyance path 10.

The receipt paper 2 is a strip-shaped thermal recording paper which is held on the roll paper holding portion 3 in a coiled state with a form of roller. Then, the receipt paper 2 held on the roll paper holding portion 3 is drawn from the front end, then guided by the guide roller 5 to pass the gap between the platen roller 7 and the thermal head 8, and finally discharged to the outside from the receipt issuing port 4 passing through the cutter mechanism 9.

The guide roller 5 guides the receipt paper 2 drawn out from the roll paper holding portion 3 towards the platen roller 7. The platen roller 7 is rotationally driven by the power of a conveying motor 16 (refer to FIG. 2) to convey the receipt paper 2 guided by the guide roller 5 to the receipt issuing port 4. Here, the actions acted by the guide roller 5, the platen roller 7 and the conveying motor 16 constitute a conveying unit for conveying the receipt paper 2. Further, the conveying unit may be any conveying unit so long as it can convey the receipt paper 2 to the receipt issuing port 4 passing through the platen roller 7 and the cutter mechanism 9, but it is not limited to the conveying unit described herein.

The thermal head 8 is arranged at a position opposite to the platen roller 7 in such a manner that the thermal head 8 can be freely contacted with or separated from the platen roller 7. Moreover, the thermal head 8 is contacted with the recording surface of the receipt paper 2 conveyed between the platen roller 7 and the thermal head 8 and applies thermal energy to print words on the recording surface. Here, the thermal head 8 constitutes a thermal printing unit is constituted by printing data on the receipt paper 2 in a thermal type by the thermal head 8.

The cutter mechanism 9, which is arranged between the platen roller 7 and the receipt issuing port 4 on the paper conveyance path 10, consists of the combination of a fixed blade 9*a* and a movable blade 9*b*, wherein the movable blade 9*b* slides with respect to the fixed blade 9*a* to cut off the receipt paper 2 conveyed along the paper conveyance path 10 at any position. Then, the cut-off receipt paper is issued from the receipt issuing port 4 as a receipt 20 (refer to FIG. 4).

The mark sensor 6 is configured between the guide roller 5 and the platen roller 7 on the paper conveyance path 10 to optically detect the mark 32 (refer to FIG. 3) set on the back side of the receipt paper 2 which is opposite to the recording surface of the receipt paper 2.

In addition, as shown in FIG. 2, the receipt printer 1 is provided with a CPU (Central Processing Unit) 11 serving as the main body of a control section is carried on the receipt printer 1. Moreover, the CPU 11 is connected with memory sections such as a ROM (Read Only Memory) 13 and a RAM (Random Access Memory) 14 and an interface 15 for communicating with a POS control section 17 via a bus line 12 such as an address bus or a data bus. Further, the receipt printer 1 connects each one of the conveying motor 16, the thermal head 8, the cutter mechanism 9 and the mark sensor 6 with the bus line 12 via a signal input/output section (not shown in figures).

Figure 3:
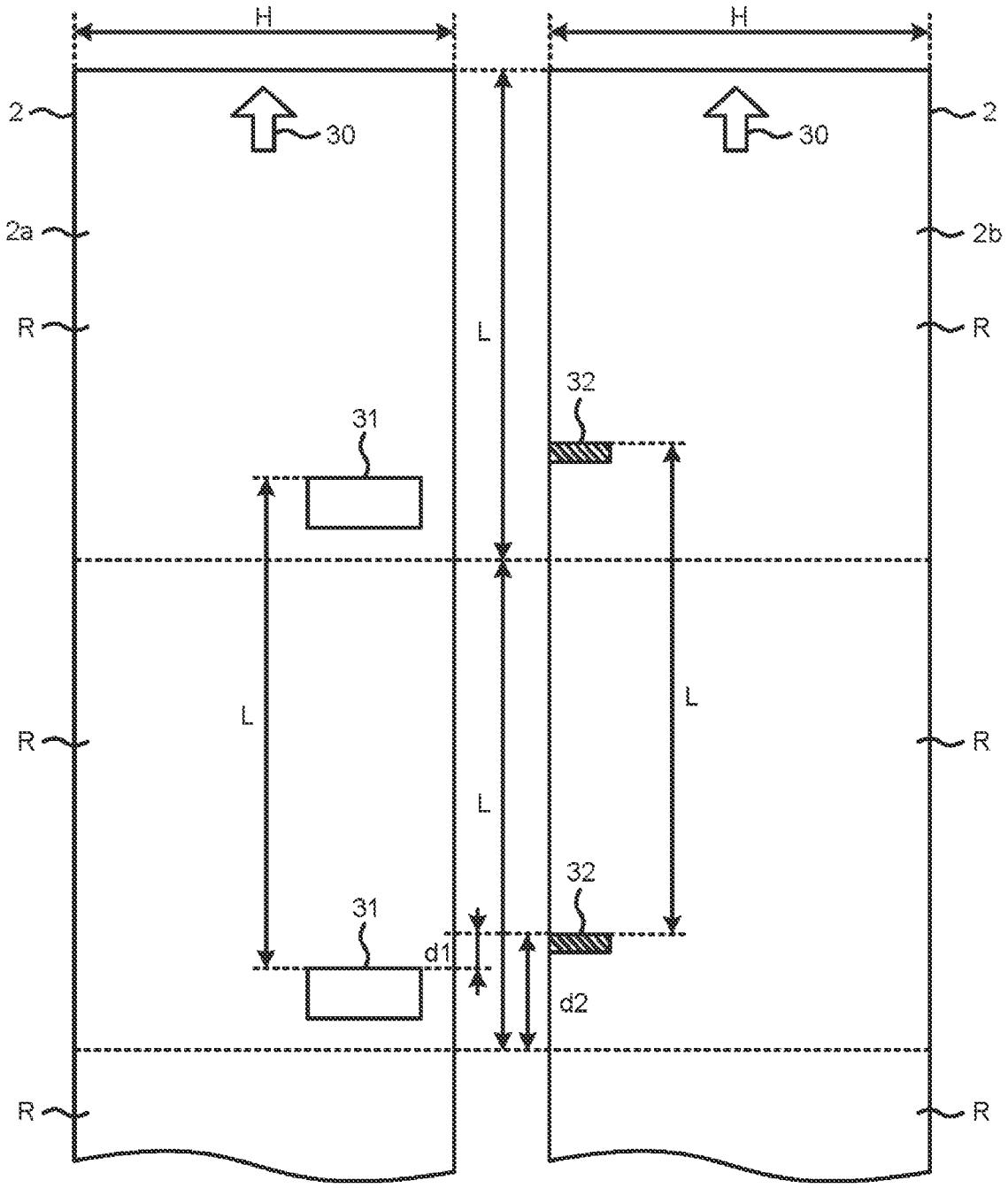
FIG. 3 is a schematic diagram illustrating the surface and the back-side of a receipt paper used according to the same embodiment.

Fixed data, such as the program data or setting data and the like including a control program which will be described later is stored in the ROM 13 in advance. The ROM 14 comprises kinds of memory areas such as a buffer area in which the printing data printed on the receipt 20 is expanded, a count area, a flag area and the like. The RAM 14 further has an area for storing variable data such as the message printed on the receipt 20. The interface 15 receives the detail data of a commodity transaction from the POS control section 17. The detail data contains: a transaction commodity detail data such as transaction date and time, transaction number, transaction identification data (manager code, etc.), commodity code, commodity name and price, and a checkout detail data such as subtotal amount, amount of exclusion from including tax, amount of including tax, total amount, deposit amount and charge amount FIG. 3 is a plan view illustrating a part of the recording surface 2*a* and a back side 2*b* opposite to the recording surface 2*a* of the receipt paper 2. Further, in FIG. 3, the arrow 30 indicates the direction in which the receipt paper 2 is conveyed by the conveying unit.

As shown in FIG. 3, pieces of promotion information 31 in a same size (rectangle) are printed on the paper in the longitudinal direction of the paper and separated from each other by a predetermined distance. Seen from the side of the recording surface 2*a*, the promotion information 31 is located on the right side in the width direction of the paper which is orthogonal to the longitudinal direction of the paper. The promotion information 31, which is, for example, discount information such as '500 Yen off' or benefit information such as 'free gift offered', is pre-printed on the recording surface 2*a* of the receipt paper 2 serving as a thermal recording paper, that is, the surface coated with chemical agents used to change the color by heated, in a printing type different from the thermal type, which is, for example, a thermal transfer type or a dry electro-photographic type. Thus, although the letters printed on the recording surface 2*a* in a thermal type will fade and disappear as time elapse, the promotion information 31 will not fade and therefore will not disappear as time elapse.

On the other hand, marks 32 in a same size (rectangle) are printed on the back side 2*b* along the longitudinal direction of the paper, located at positions a distance d1 prior to the promotion information 31 in the conveying direction 30 and separated from each other by a predetermined distance. Seen from the side of the back side 2*b*, the mark 32 is located on the left in the width direction of the paper. As the promotion information 31, the mark 32 is printed in a printing type different from thermal printing type.

The length obtained by adding the interval between two pieces of promotion information 31 to the width of each piece of promotion information 31 in the longitudinal direction of the paper is equal to that obtained by adding the interval between two marks 32 to the width of each mark 32 in the longitudinal direction of the paper. The length is set to be 'L'.

The mark sensor 6 is arranged at a position where the mark 32 can be detected from the back side 2*b* of the receipt paper 2 conveyed along the paper conveyance path 10. The receipt paper 2 is selectively cut off by the cutter mechanism 9 along the width direction of the paper at a position which is a distance d2 away from the mark 32 in a direction reverse to the conveying direction 30 and then issued as a receipt 20. The distance d2 is a little longer than the length obtained by adding the distance d1 to the width of the promotion information 31 in the longitudinal direction of the paper.

Therefore, the receipt paper 2 is a paper formed by integrating a row of receipt bars R in the longitudinal direction of the paper, each receipt bar R taking the shape of an H*L rectangle, wherein H is the length of the rectangle in the width direction of the paper. Moreover, one piece of promotion information 31 must be printed on the recording surface 2*a* of a receipt bar R, and a mark 32 must be printed on the back side 2*b* of the recording surface 2*a*.

Besides, the promotion information 31 printed on recording surfaces 2*a* of different receipt bars R is not necessarily the same, and promotion information 31 of different contents may be printed in advance for different receipt bars R.

Figure 4:
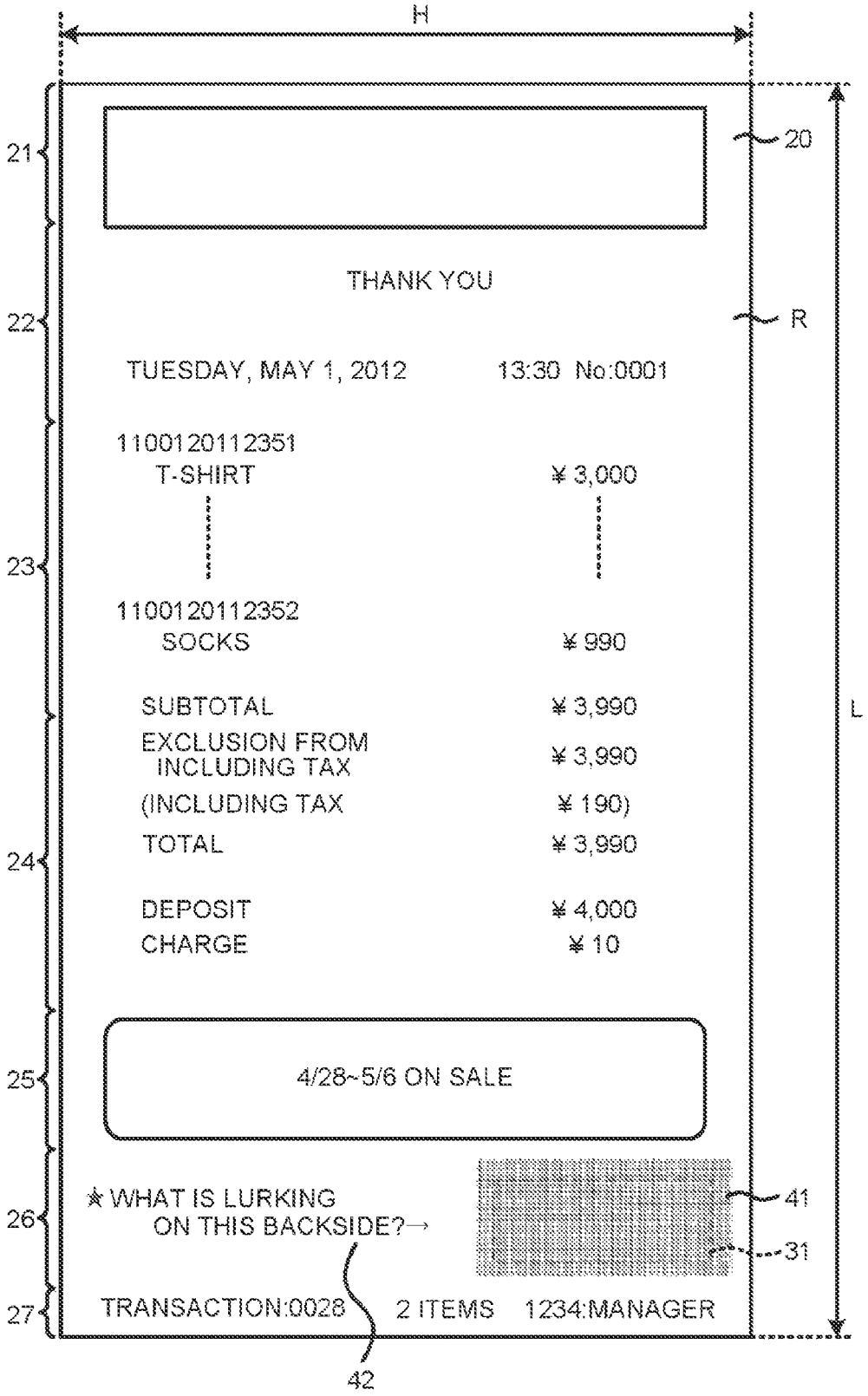
FIG. 4 is a diagram illustrating an example of a simplex receipt issued according to the same embodiment.

FIG. 4 is a plan view illustrating an example of an issued receipt 20. The size of the receipt 20 is the same as that of a receipt bar R. As shown in FIG. 4, starting from the front end (the end from which the receipt is discharged from the receipt issuing port 4) of the receipt 20, head data such as shop name and log are printed in an area 21, a message and a transaction date and time are printed in an area 22, detail data of a plurality of commodities transacted is printed in an area 23, checkout detail data is printed in an area 24, variable promotion data is printed in an area 25, and transaction closing data is printed in an area 27. The summary data includes a transaction number, a sales volume and the code of a manager.

Further, in an area 26 in which promotion information 31 is printed in advance, mask data 41 for hiding the promotion information 31 and a message 42 (e.g. 'What is lurking on this backside?') for notifying the printing of promotion-related information at the position where mask data 41 is printed are printed on the promotion information 31.

The same lines of data are printed in each of the areas 21, 22, 24, 25, 26 and 27. Thus, the areas 21, 22, 24, 25, 26 and 27 are fixed in size. On the other hand, a receipt 20 including a receipt bar R is also fixed in size. Thus, like the areas 21, 22, 24, 25, 26 and 27, the area 23 is also fixed in size, and the amount of the transacted commodity detail data that can be printed in the area 23 is consequentially limited. In this embodiment, the upper limit value of the amount of the transacted commodity detail data that can be printed in the area 23 is set to be N (N is more that 2).

Figure 5:
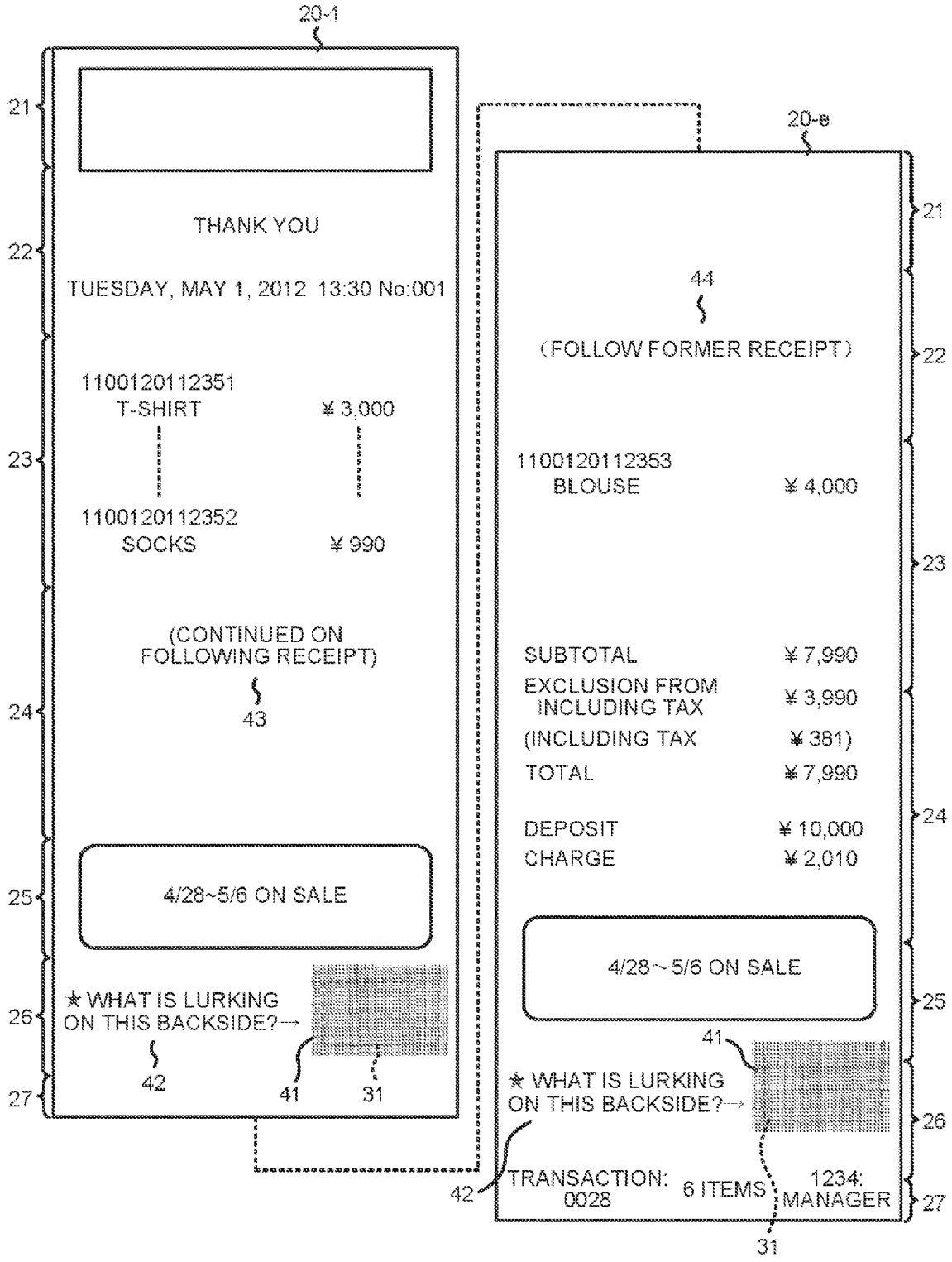
FIG. 5 is a diagram illustrating an example of a continuation receipt and the last receipt issued according to the same embodiment.

The amount of the transacted commodity detail data is changed with the amount of the commodities sold in one commodity transaction. In this embodiment, if the amount of the transacted commodity detail data exceeds the upper limit value N, then there are provided at least two receipts 20-1, 20-2 (e is more that 2), as shown in FIG. 5. In this case, checkout detail data is only printed on the last receipt 20-*e*. Further, a message 43, such as 'continue on the following receipt', which notifies that the transacted commodity detail data printed in the area 23 is 'continued on the following receipt', is printed in the areas 24 of the other receipts 20-1, . . . , 20-(*e*-1) different from the last receipt. Similarly, a message 44, such as 'follow the former receipt', which notifies that the transacted commodity detail data printed in the area 23 of a receipt is the follow-up of the transacted commodity detail data printed in the former receipt, is printed in the areas 21 and 22 of the other receipts 20-2, . . . , 20-(e) different from the first receipt 20-1. It can be understood that such messages 43 and 44 are messages notifying the issuing of a plurality of receipts in one commodity transaction.

Figure 6:
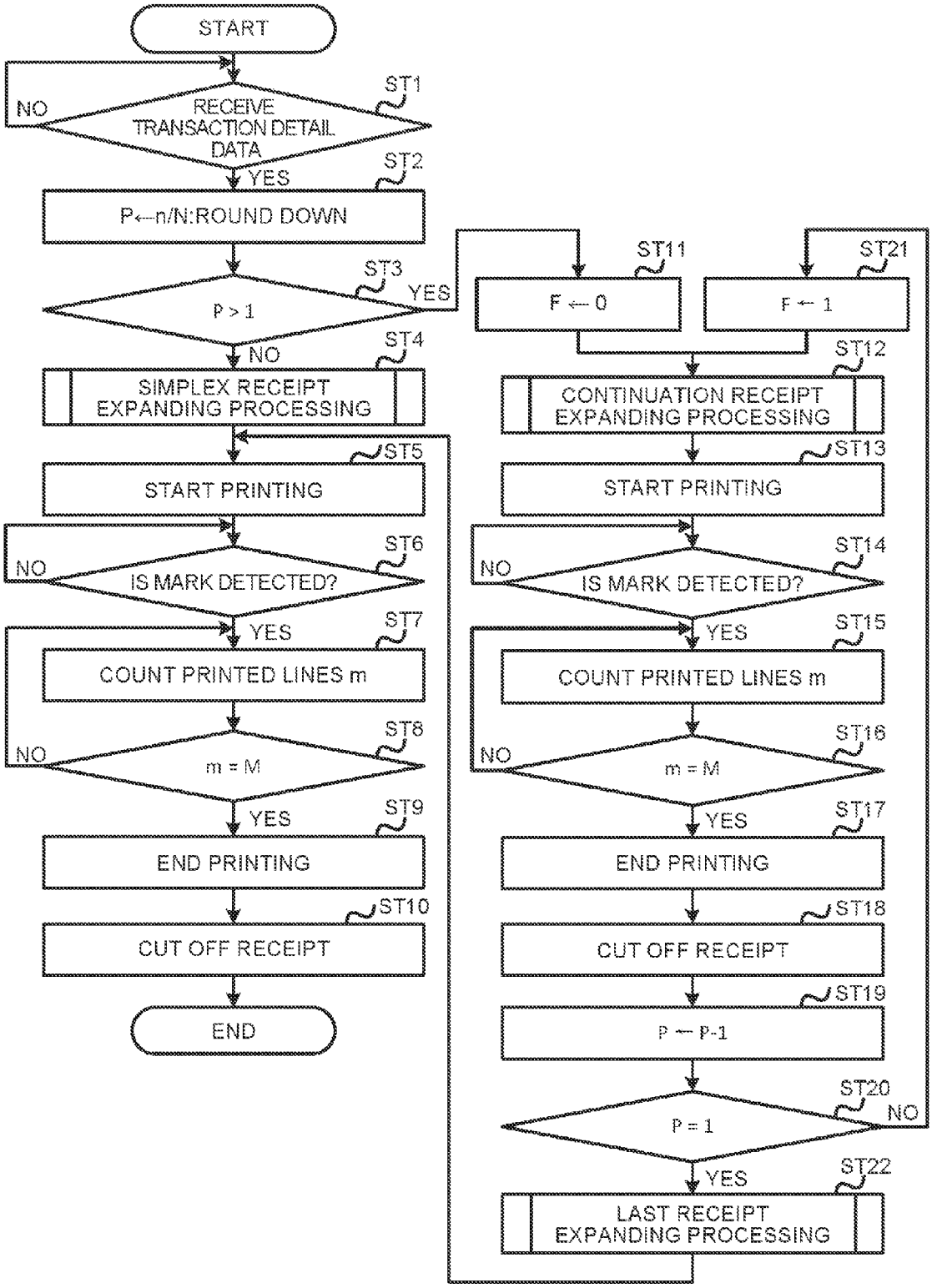
FIG. 6 is a flowchart illustrating the main components of the information processing procedures executed by the CPU of the same receipt printer in accordance with a control program.

FIG. 6 is a flowchart illustrating the procedures of a receipt issuing processing controlled by the CPU 11. The CPU 11 controls the receipt issuing processing in accordance with a control program stored in the ROM 13.

First, the CPU 11 stands by to wait for the input of the detail data (transaction identification data, detail data of more than one commodity transaction, checkout detail data) of a commodity transaction from the POS control section 17 (ST1). The CPU 11 receives the detail data of a commodity transaction via the interface 15 and stores the detail data in the RAM 13, and determines the issue number of receipts for the one commodity transaction (ST2: issue number determination unit). Specifically, the CPU 11 calculates the amount n of the transacted commodity detail data contained in the detail data. Sequentially, the CPU 11 divides the amount n by the upper limit value N of the amount of the transacted commodity detail data printable in the area 23, and rounds down the quotient to calculate an issue number P.

Figure 7:
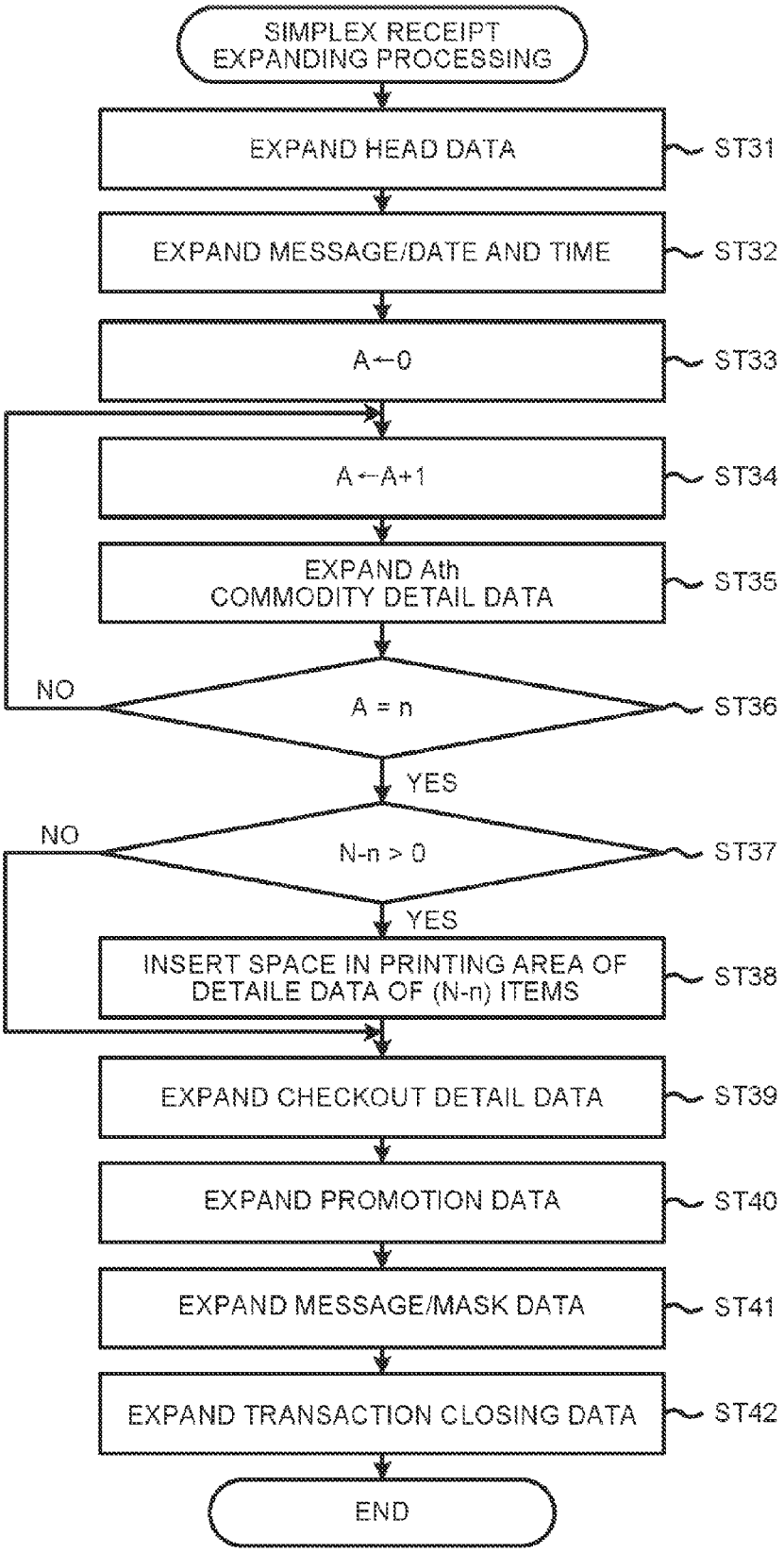
FIG. 7 is a flowchart illustrating specific procedures of a simplex receipt expanding processing shown in FIG. 6.

The CPU 11 confirms whether or not the issue number P is greater than 1 (ST3). The issue number P is 1 if the amount n of the transacted commodity detail data is smaller than or equal to the upper limit value N (NO in ST3). In this case, the CPU 11 executes the simplex receipt expanding processing shown in FIG. 7.

That is, the CPU 11 first expands the head data (e.g. shop name and log and the like) printed in the area 21 of the receipt 20 in the buffer area (ST31). Then, the CPU 11 expands the specified message and transaction date and time and the like printed in the area 22 following the head data in the buffer area (ST32). The head data and the message data are preset in the ROM 13 or RAM 14. Transaction date and time data is obtained from the received transaction identification data.

Next, the CPU 11 resets the count value A of the data quantity stored in a count area to be 0 (ST33). Besides, the timing at which the count value A is reset may be prior to the processing of ST31 or between the timing of the processing of ST31 and the timing of the processing of ST32, but is not limited to be after the processing of ST32.

The CPU 11 counts up the count value A of the data quantity by 1 at a time (ST34). Moreover, the CPU 11 orderly reads the transacted commodity detail data printed in the areas 23 from the received detail data of a commodity transaction every time the count value A of the data quantity is counted up and expands the transacted commodity detail data in the buffer area (ST 35). Further, the CPU 11 confirms whether or not the count value A of the data quantity is matched with the amount n of the transacted commodity detail data every time the count value A of the data quantity is counted up (ST36). The CPU 11 repeats to execute the processing of ST34 and ST35 until the count value A of the data quantity is matched with the amount n of the transacted commodity detail data.

If the count value A of the data quantity is matched with the amount n of the transacted commodity detail data (Yes in ST36), then the CPU subtracts the amount n of the transacted commodity detail data from the upper limit value N and confirms whether or not the difference (N−n) is greater than 0 (ST37). If the difference (N−n) is greater than 0 (Yes in ST37), the CPU 11 expands space data in the buffer area in order to use the printing area of the transacted commodity detail data of (N−n) items as a space (ST38). If the difference (N−n) is 0 (No in ST37), the CPU 11 does not execute the processing in ST38.

Then, the CPU 11 acquires the checkout detail data printed in the area 24 from the received detail data of a commodity transaction and expands the checkout detail data in the buffer area (ST39). Moreover, the CPU 11 reads the promotion data printed in the area 25 from the RAM 14 and expands the promotion data in the buffer area (ST40). Further, the CPU 11 reads the data of the mask data 41 and the message 42 printed in the area 26 from the RAM 14 and expands the data of the mask data 41 and the message 42 in the buffer area (ST41). Finally, the CPU 11 reads the transaction closing data (transaction number, sales volume, code of manager) printed in the area 27 from the detail data of a received commodity transaction and expands the transaction closing data in the buffer area (ST42). Then, the simplex receipt expanding processing is ended.

When the simplex receipt expanding processing is ended, the CPU 11 controls the drive for the conveying motor 16 and the thermal head 8 to start a printing control on the receipt printing data expanded in the buffer area. During the printing control process, the CPU 11 stands by to wait until a mark 32 is detected by the mark sensor 6 (ST6). If a mark 32 is detected (Yes in ST6), then CPU 11 counts the number m of the lines printed later (ST7). Then, the CPU 11 confirms whether or not the number m reaches a predetermined value M (ST8).

The predetermined value M defines the printed lines needed by the mark 32 detected by the mark sensor 6 to pass the cutter mechanism 9 and reach a position a distance d2 from the cutter mechanism 9. If the number of printed lines m reaches the predetermined value M (Yes in ST8), then the CPU 11 ends the printing control on the receipt printing data expanded in the buffer area (ST9). The CPU 11 activates the cutter mechanism 9 to cut off the receipt paper (ST10). For example, a simplex receipt 20 containing the content shown in FIG. 4 is issued from the receipt issuing port 4 through the control above.

Figure 8:
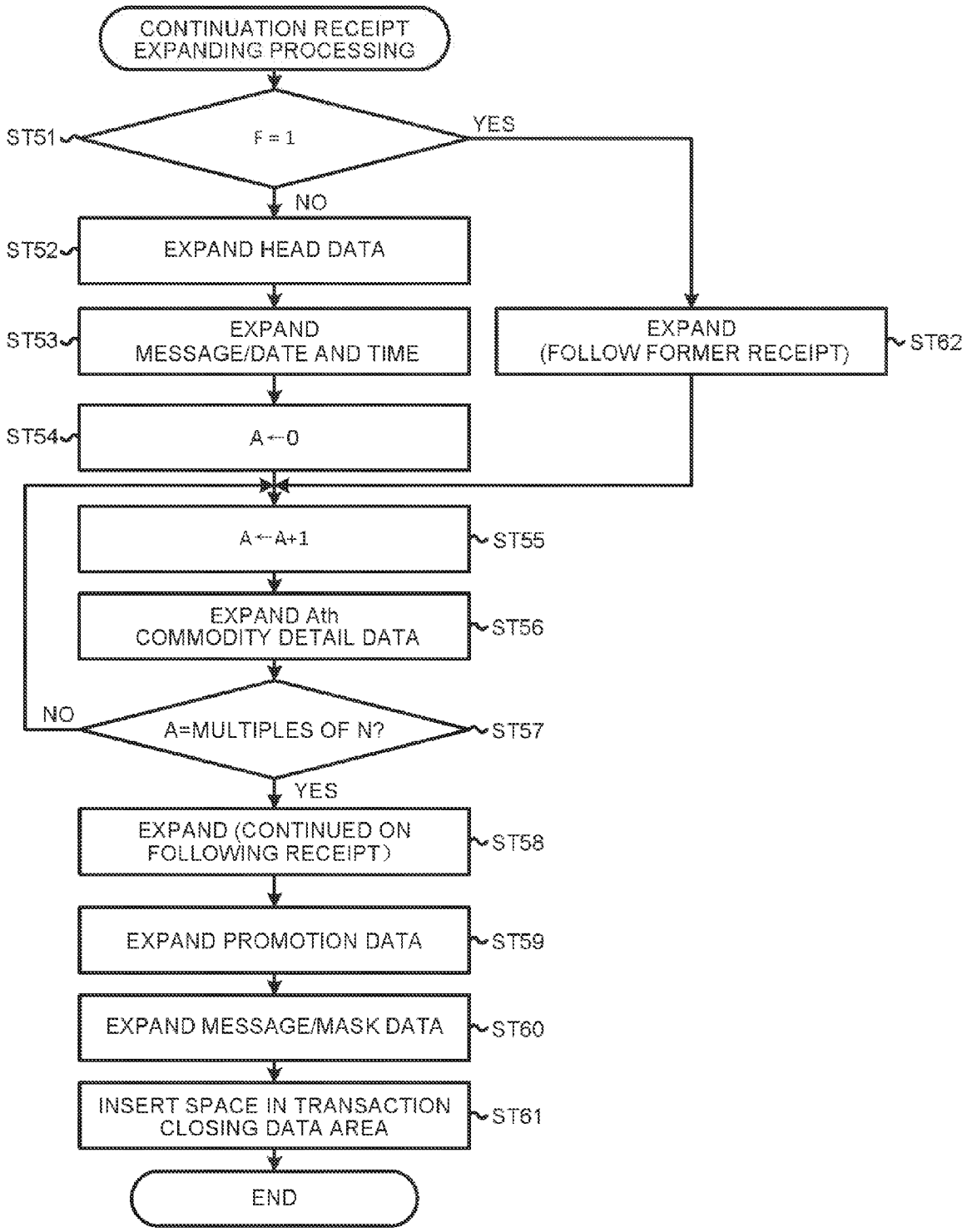
FIG. 8 is a flowchart illustrating specific procedures of a continuation receipt expanding processing shown in FIG. 6.

On the other hand, if the amount n of the transacted commodity detail data is greater than the upper limit value N, the issue number P will be greater than 1 (Yes in ST3). In this case, the CPU 11 resets the issuing control flag F stored in the flag area to be 0 (ST11). Next, the CPU 11 executes the continuation receipt expanding processing specifically shown in FIG. 8.

That is, the CPU 11 first checks an issuing control flag F. At this moment, as the issuing control flag F is reset to be 0, the CPU 11 executes the same processing of ST31-ST35 described in the simplex receipt expanding processing and makes these processing as ST52-ST56 respectively. That is, the CPU 11 expands head data such as shop name and log and the like in the buffer area (ST52). Then, the CPU 11 expands the specific message and transaction date and time following the head data in the buffer area (ST53). Next, the CPU 11 resets the count value A of the data quantity to be 0 (ST54). Then, the CPU 11 orderly reads the transacted commodity detail data printed in the areas 23 of the receipt 20 from the received detail data of a commodity transaction every time the count value A of the data quantity is counted up by 1 (ST55) and expands the transacted commodity detail data in the buffer area (ST56).

In the continuation receipt expanding processing, the CPU 11 confirms whether or not the count value A of the data quantity is a multiple of the upper limit value N (ST57). The CPU 11 repeats to execute the processing of ST55 and ST56 until the count value A of the data quantity becomes an integral multiple of the upper limit N.

If the count value A of the data quantity becomes an integral multiple of the upper limit value N (Yes in ST57), the CPU 11 reads the data of the message 43 printed in the areas 24 of other receipts 20-1, . . . , 20-(*e*-1) different from the last receipt from the RAM 14 and expands the data in the buffer area (ST58). Moreover, the CPU 11 reads the promotion data printed in the area 25 from the RAM 14 and expands the promotion data in the buffer area (ST59). Further, the CPU 11 reads the data of the mask data 41 and the message 42 printed in the area 26 from the RAM 14 and expands the data of the mask data 41 and the message 42 in the buffer area (ST60). Last, the CPU 11 expands space data in the buffer area by taking the print area of the transaction closing data in the area 27 as a space (ST61). Then, the continuation receipt expanding processing is ended.

When the continuation receipt expanding processing is ended, the CPU 11 executes the same processing of ST5-ST10 in ST13-ST18. That is, the CPU 11 controls the drive for the conveying motor 16 and the thermal head 8 to start a printing control on the receipt printing data expanded in the buffer area (ST13). During the printing control process, the CPU 11 stands by to wait until a mark 32 is detected by the mark sensor 6 (ST14). If a mark 32 is detected (Yes in ST14), then CPU 11 counts the number of the lines printed later (ST15). Then, the CPU 11 confirms whether or not the number m of the lines printed reaches a predetermined value M (ST16). If the number m of the lines printed reaches the predetermined value M (Yes in ST16), then the CPU 11 ends the printing control on the receipt printing data expanded in the buffer area (ST17). The CPU 11 activates the cutter mechanism 9 to cut off the receipt paper (ST18).

The CPU 101 subtracts '1' from the issue number P (ST19). Then, the CPU 11 confirms whether or not the issue number P is greater than 1 (ST20). If the issue number P is still greater than 1 (No in ST20), the CPU 11 sets the issuing control flag F to be 1 (ST21). Then, the CPU 11 executes the continuation receipt expanding processing again (ST12). In this case, as the issuing control flag F is set to be 1, the CPU 11 reads the data of the message 44 printed in areas 21 and 22 of the receipts 20-2, . . . , 20-*e* different from the first receipt 20-1 from the RAM 14 and expands the data in the buffer area (ST62).

Then, the CPU 11 executes the processing of ST55-ST61 again. That is, the CPU 11 counts up the count value A of the data quantity by 1 (ST55) and then orderly reads the transacted commodity detail data printed in the areas 23 of the receipt 20 from the received detail data of a commodity transaction and expands the transacted commodity detail data in the buffer area until the count value A of the data quantity is counted up to an integral multiple of the upper limit value N (ST56).

If the count value A of the data quantity becomes an integral multiple of the upper limit value N (Yes in ST57), the CPU 11 reads the data of the message 43 printed in the areas 24 from the RAM 14 and expands the data in the buffer area (ST58). Moreover, the CPU 11 reads the promotion data printed in the area 25 from the RAM 14 and expands the promotion data in the buffer area (ST59). Further, the CPU 11 reads the data of the mask data 41 and the message 42 printed in the area 26 from the RAM 14 and expands the data of the mask data 41 and the message 42 in the buffer area (ST60). Last, the CPU 11 expands space data in the buffer area by taking the printing area of the transaction closing data in the area 27 as a space (ST61). Then, the continuation receipt expanding processing is ended.

When the continuation receipt expanding processing is ended, the CPU 11 executes the processing of ST13-ST20 again. As a result, the CPU 11 will execute the continuation receipt expanding processing while the issuing control flag F is being set to be 1 (ST21) if the issue number P is still greater than 1 (No in ST20) (ST12).

Figure 9:
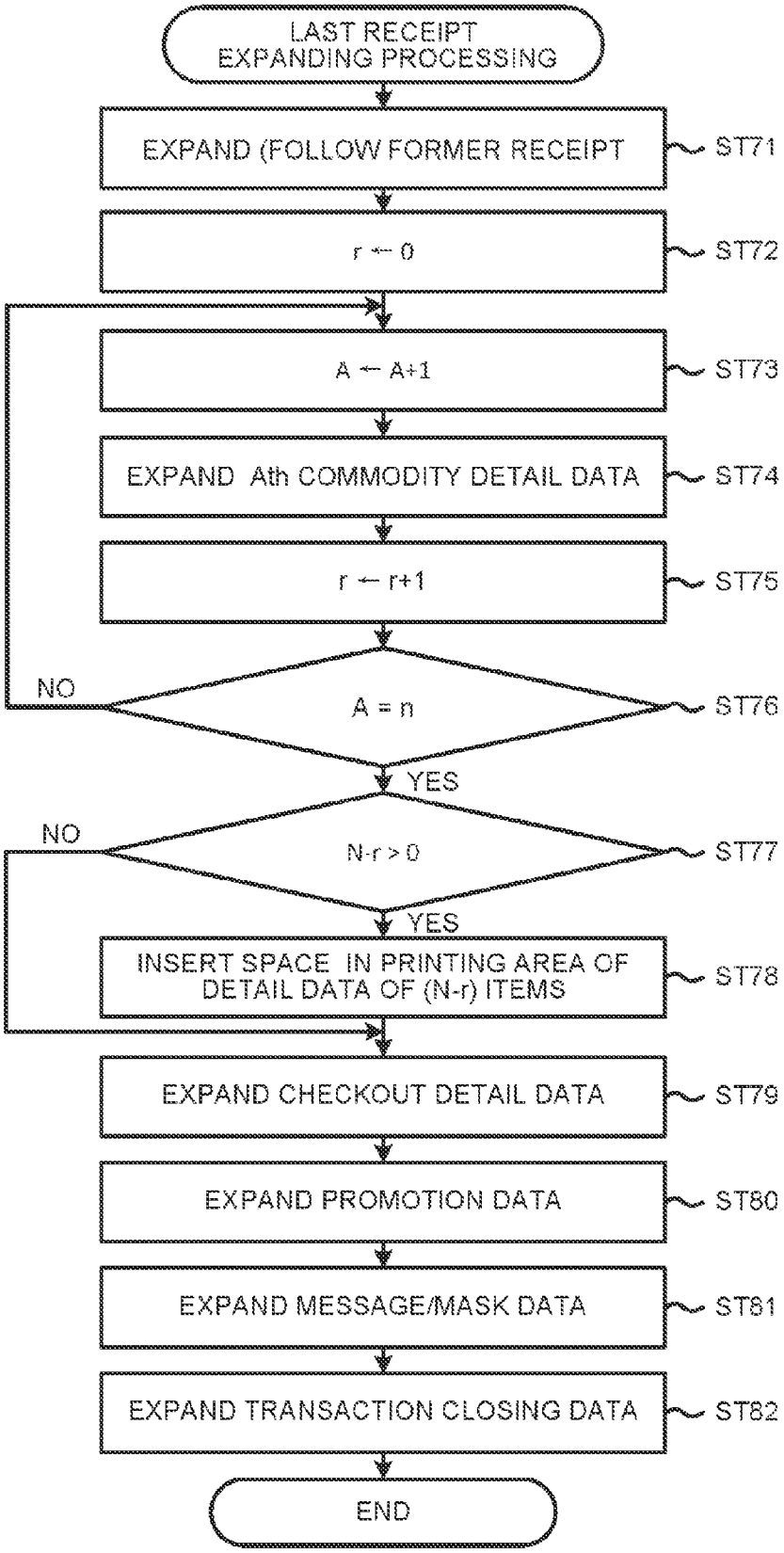
FIG. 9 is a flowchart illustrating specific procedures of a last receipt expanding processing shown in FIG. 6.

With respect to this, if the issue number P becomes 1 (Yes in ST20), the CPU 11 executes the last receipt expanding processing shown in FIG. 9 in detail (ST22).

That is, the CPU 11 reads the data of the message 44 printed in the areas 21 and 22 of the last receipt 20-*e* from the RAM 14 and expands the data in the buffer area (ST71). Next, the CPU 11 resets the count value r of the printing quantity stored in the count area to be 0 (ST72).

The CPU 11 counts up the count value A of the data quantity by 1 at a time (ST73). Moreover, the CPU 11 reads the transacted commodity detail data printed in the area 23 from the detail data of a received commodity transaction every time the count value A of the data quantity is counted up and expands the transacted commodity detail data in the buffer area (ST 74). The CPU 11 counts up the count value r of the printing quantity by 1 (ST75).

The CPU 11 confirms whether or not the count value A of the data quantity is matched with the amount n of the transacted commodity detail data every time the count value A of the data quantity is counted up (ST76). The CPU 11 repeats to execute the processing of ST73, ST74 and ST75 until the count value A of the data quantity is matched with the amount n of the transacted commodity detail data.

If the count value A of the data quantity is matched with the amount n of the transacted commodity detail data (Yes in ST76), then the CPU 11 subtracts the count value r of the printing quantity from the upper limit value N and confirms whether or not the difference (N−r) is greater than 0 (ST77). If the difference (N−r) is greater than 0 (Yes in ST77), then the CPU 11 expands space data in the buffer area in order to use the printing area of transacted commodity detail data of (N−r) items as a space (ST78). If the difference (N−r) is 0 (No in ST77), the CPU 11 does not execute the processing in ST78.

Then, the CPU 11 picks up the checkout detail data printed in the area 24 from the detail data of a received commodity transaction and expands the checkout detail data in the buffer area (ST79). Moreover, the CPU 11 reads the promotion data printed in the area 25 from the RAM 14 and expands the promotion data in the buffer area (ST80). Further, the CPU 11 reads the data of the mask data 41 and the message 42 printed in the area 26 from the RAM 14 and expands the data of the mask data 41 and the message 42 in the buffer area (ST81). Finally, the CPU 11 acquires the transaction closing data (transaction number, sales volume, code of manager) printed in the area 27 from the detail data of a received commodity transaction and expands the transaction closing data in the buffer area (ST82). Then, the last receipt expanding processing is ended.

When the last receipt expanding processing is ended, the CPU 11 executes a same processing to the processing of ST5-ST10. That is, the CPU 11 controls the drive for the conveying motor 16 and the thermal head 8 to start a printing control on the receipt printing data expanded in the buffer area (ST5). During the printing control process, the CPU 11 stands by to wait until a mark 32 is detected by the mark sensor 6 (ST6). If a mark 32 is detected (Yes in ST6), then CPU 11 counts the number m of the lines printed later (ST7). Then, the CPU 11 confirms whether or not the number m of the lines printed reaches a predetermined value M (ST8). If the number m of the lines printed reaches the predetermined value M (Yes in ST8), then the CPU 11 ends the printing control on the receipt printing data expanded in the buffer area (ST9). The CPU 11 activates the cutter mechanism 9 to cut off the receipt paper (ST10). For example, a continuation receipt 20-1 and a last receipt 20-*e* containing the content shown in FIG. 5 can be issued from the receipt issuing port 4 through the control above.

Here, the processing of ST41, ST60 and ST81, and the processing of ST5 and ST13 constitute a mask printing control unit and a prompt printing control unit. Further, the processing of ST58 and ST71 and the processing of ST5 and ST13 constitute a notification printing control unit. Further, the processing of ST40, ST59 and ST80 and the processing of ST5 and ST13 constitute a promotion printing control unit. Further, the processing of ST6-ST10 or the processing of ST14-ST18 constitutes an issuing control unit.

In the embodiments having the structure above, a simplex receipt 20 having the layout shown in FIG. 4 is issued for a customer if the amount n of the detail data of the commodities purchased by the customer is smaller than or equal to the upper limit value N. Further, at least one continuation receipt 20-1 and a last receipt 20-*e* having the layout shown in FIG. 5 will be issued for a customer if the amount n of the detail data of the commodities purchased by the customer is greater than the upper limit value N.

Mask data 41 is printed on the promotion information 31 pre-printed in the area 26 of any one of the simplex receipt 20, the continuation receipt 20-1 and the last receipt 2-*e*. The mask data 41 is printed on the receipt paper 2 serving as a thermal recording paper in a thermal type, thus, the printing density of the mask data 41 reduces gradually as time goes by. As a result, the promotion information 31 hided by the mask data 41 can be seen, for example, after about one or two weeks.

The promotion information 31 is discount information such as '500 Yen off' or benefit information such as 'free gift offered' and the like. In a retail shop where the receipt issuing apparatus described herein is used, the benefit recorded on a receipt on which the promotion information 31 under the mask data 41 is observable after the mask data 41 disappears is acknowledged. Therefore, the customer who shopped in the retail shop will come to the retail shop again, as a result, the customer will be attracted to shop in the retail shop more times, thus achieving a promotion effect.

In the embodiment, the issued receipt can be effectively used as a service voucher such as a discount voucher or a coupon voucher, which prevents the phenomenon that the customer rejects to accept a receipt or tear up the receipt received.

Moreover, in the embodiment, if a great number of commodity items are purchased in one commodity transaction, then the number of the receipts issued in the commodity transaction is increased, and promotion information 31 is printed on each receipt. Thus, it is predicted that more customers will purchase more commodities to obtain more preference. Thus, the promotion effect will be more remarkable.

In the embodiment, when a plurality of receipts is issued in one commodity transaction, messages 43 and 44 notifying the issuing of the plurality of receipts for the commodity transaction are printed on each receipt. Therefore, the following error can be prevented at an extremely high probability: the cashier only offers one receipt to the customer although a plurality of receipts is issued for a commodity transaction or the customer does not accept the receipts.

In the embodiment, the message 42 notifying the printing of promotion-related information at the printing position of the mask data 41 of a receipt is printed at the same position. Thus, the possibility is reduced that the customer overlooking the benefit indicated by the promotion information 31 printed on a receipt and tearing up the receipt.

Further, in the embodiment, promotion-related information different in content from the promotion information 31 is printed next to the mask data 41 printed on the receipt. Thus, services are provided to the customer with one receipt by two steps, thus endowing the customer with great satisfaction. As a result, customers are attracted more reliably, and promotion effect is significantly improved.

The present embodiment is not limited to the embodiments above.

A thermal receipt printer 1 arranged in a POS terminal is used as a receipt issuing apparatus in embodiments described herein, however, the receipt issuing apparatus is not limited to this. For example, the receipt printer externally installed on the settlement terminal of an electronic cash register or POS terminal and the like can be also applicable.

In the embodiments described herein, at least one continuation receipt 20-1 and one last receipt 20-*e* having the layout shown in FIG. 5 are issued for a customer if the amount n of the detail data of the commodities purchased by the customer is greater than the upper limit value N, however, the continuation receipt 20-1 and the last receipt 20-*e* may be issued as one receipt by omitting the processing of ST18 shown in FIG. 6.

In the embodiments above, the mask data 41 is set as the data with a mesh pattern, as shown in FIG. 4 and FIG. 5, however, the type of the mask data 41 is not limited specifically. For example, the mask data can be any data that is high in the density of black printing part such as a two-dimensional data code and can block the promotion information 31.

The promotion information 31 and the mark 32 take the shape of a rectangle respectively in the embodiments above, but those shapes are not limited to this. No limitation is predetermined to the shape of the promotion information 31 as long as the promotion information 31 can be hided by the mask data 41. Further, no limitation is predetermined to the shape of the mark 32 as long as the mark 32 can be detected by the mark sensor 6.

The mark 32 can be arranged at any position where the mark 32 can be detected by the mark sensor 6 and cut off by the cutter mechanism 9 while the promotion information 31 is not cut off, but is not limited to that described herein.

In the embodiments above, the control program for realizing the functions of the present embodiment are prerecorded in the ROM 13, which is a program storage section arranged in the apparatus. However, the present embodiment is not limited to this example, the same program can also be downloaded to the apparatus from a network. Alternatively, the same program recorded in a recording medium can also be installed in the apparatus. If the recording medium can store programs like a CD-ROM and a memory card and is apparatus-readable, then the form of the recording medium is not limited. Further, the functions acquired by an installed or downloaded program can be also realized by synergistically acting with the OS (Operating System) and the like inside the apparatus.

While certain embodiments have been described, these embodiments have been presented by way of example only, and are not intended to limit the scope of the invention. Indeed, the novel embodiments described herein may be embodied in a variety of other forms; furthermore, various omissions, substitutions and changes in the form of the embodiments described herein may be made without departing from the spirit of the invention. The accompanying claims and their equivalents are intended to cover such forms or modifications as would fall within the scope and spirit of the invention.

What is claimed is:

1. A receipt issuing apparatus, comprising:

a conveying unit configured to convey a receipt paper which consists of a strip-shaped thermal recording paper and on which pieces of promotion-related information are pre-printed at predetermined positions which are arranged at regular intervals in the longitudinal direction of the receipt paper;

a thermal printing unit configured to print the detail data of a commodity transaction on the receipt paper conveyed by the conveying unit by thermal printing;

a mask printing control unit configured to overprint a mask data for hiding the promotion-related information on the receipt paper by the thermal printing unit; and an issuing control unit configured to issue a receipt by cutting off the receipt paper on which mask data is printed by the mask printing control unit at a position more upstream than the printing position of the mask data in the conveying direction of the conveying unit.

2. The receipt issuing apparatus according to claim 1, further comprising:

an issue number determination unit configured to determine the issue number of the receipts for one commodity transaction based on the amount of the detail data, wherein the mask printing control unit prints the mask data in such a manner that the promotion-related information printed on the receipts based on the issue number of which is determined by the issue number determination unit is completely hid.

3. The receipt issuing apparatus according to claim 2, further comprising:

a notification printing control unit configured to print a message notifying the issuing of a plurality of receipts for one commodity transaction on each of the receipts by the thermal printing unit in the case that the issue number of receipts determined by the issue number determination unit is more than one receipt.

4. The receipt issuing apparatus according to claims 1, further comprising:

a prompt printing control unit configured to print a message notifying that the promotion-related information is printed at a position printing the mask data of the receipt printed by the thermal printing unit near the position of the mask data.

5. The receipt issuing apparatus according to claim 1, further comprising:

a promotion printing control unit configured to print the promotion-related information different from the information pre-printed at the position printing the mask data of the receipt by the thermal printing unit near the position of the mask data.

6. A control method of a receipt issuing apparatus, comprising:

conveying a receipt paper which consists of a strip-shaped thermal recording paper and on which pieces of promotion-related information are pre-printed at predetermined positions which are arranged at regular intervals in the longitudinal direction of the receipt paper;

printing the detail data of a commodity transaction on the conveyed receipt paper;

overprinting a mask data for hiding the promotion-related information on the receipt paper; and issuing a receipt by cutting off the receipt paper on which mask data is printed at a position more upstream than the printing position of the mask data in the conveying direction.

* * * * *